US005484187A

United States Patent [19]

Doerner et al.

[11] Patent Number: 5,484,187

[45] Date of Patent: Jan. 16, 1996

[54] CHAIR ARMREST ADJUSTMENT MECHANISM

[75] Inventors: Frank Doerner; William S. Stumpf, both of Kitchener, Canada

[73] Assignee: Doerner Products Ltd., Waterloo, Canada

[21] Appl. No.: 226,013

[22] Filed: Apr. 11, 1994

[51] Int. Cl.[6] ..... A47C 7/54; B60N 2/46

[52] U.S. Cl. ..... 297/411.3; 297/411.35; 297/411.36; 297/411.37; 297/411.38

[58] Field of Search ..... 297/411.31, 411.35, 297/411.36, 411.37, 411.38, 240, 242, 364

[56] References Cited

U.S. PATENT DOCUMENTS

| | | | |
|---|---|---|---|
| 3,216,764 | 11/1965 | Junkunc | 297/411.37 |
| 4,235,471 | 11/1980 | Tengler | 297/364 |
| 4,277,102 | 7/1981 | Aaras et al. | 297/411.36 |
| 4,674,790 | 6/1987 | Johnson | 297/411.36 |
| 5,143,422 | 9/1992 | Althofer et al. | 297/411.36 |

FOREIGN PATENT DOCUMENTS

| | | | |
|---|---|---|---|
| 3432084 | 3/1986 | Germany | 297/411.31 |

*Primary Examiner*—Kenneth J. Dorner
*Assistant Examiner*—Anthony Barfield
*Attorney, Agent, or Firm*—Wood, Herron & Evans

[57] ABSTRACT

A chair armrest adjustment mechanism for an armrest is disclosed. The armrest adjustment mechanism includes a first member, an upstanding second member for mounting to an armrest support member, and a third member having attachment means for fixedly attaching the third member to an armrest pad. The third member and the second member have a pin and slot arrangement to limit the rotational movement of the third member. The first member is pivotally mounted to the second member via a pin such spring cups between the first member and the second member at either side of the pin for biasing the first member to a level orientation with respect to the second member.

15 Claims, 3 Drawing Sheets

CHAIR ARMREST ADJUSTMENT MECHANISM

FIELD OF THE INVENTION

This invention relates to a chair armrest adjustment mechanism.

BACKGROUND OF THE INVENTION

Comfortable and user friendly office equipment which can be readily adapted to a user's individual needs will help to create an office work environment conducive to maximum productivity. Office chairs are an integral part of any office environment and chairs having features which can be adjusted to meet a user's requirements with respect to posture would enhance a user's comfort level and therefore, their productivity level.

The use of computer keyboards in the work place has reduced the comfort level of office chairs since an occupant's arms are not properly supported during keyboard use. This invention seeks to overcome this problem by providing an armrest adjustment mechanism which can be utilized in a chair armrest so that the armrest adapts to the user's movement while continuing to provide forearm support.

SUMMARY OF THE INVENTION

This invention seeks to provide armrests having armrest pads which are rotatable and/or tiltable to accommodate the natural movements of the chair user while providing support. Rotational movement allows a keyboard user to span quickly across the keyboard without having to remove his or her arms from the support of the armrest. Forward and backward tilt movement of the armrest pad allows the chair user to position the arms in the most comfortable and natural position when using a keyboard or similar device, or when resting.

Accordingly, the subject invention provides a chair armrest adjustment mechanism comprising a member having attachment means for mounting said member to an armrest pad, support means for mounting to an armrest support, mounting means for mounting said armrest pad member to said support means for side-to-side rotational movement of said armrest pad member relative to said support means, limiting means for limiting side-to-side rotational movement of said armrest pad member on said support means comprising a pin and slot arrangement, said pin extending from one of said armrest pad member and said support means and said slot extending in another of said armrest pad member and said support means, said slot comprising an arcuate array of holes, each of said holes sized such that on insertion of said pin into any one of said holes, said armrest pad member is fixedly positioned with respect to side-to-side rotational movement on said support means.

According to another aspect the subject invention provides a chair armrest adjustment mechanism comprising a member having attachment means for mounting said member to an armrest pad, support means for mounting to an armrest support, mounting means for mounting said armrest pad member to said support means for side-to-side rotational movement of said armrest pad member relative to said support means; and one of said armrest pad member and said support means comprising a raised pad facing the other of said armrest pad member and said support means, for reducing the frictional resistance between said armrest pad member and said support means during rotational movement.

BRIEF DESCRIPTION OF THE DRAWINGS

The following is a description, by way of example only, of the preferred embodiment of the chair armrest adjustment mechanism forming the subject invention, reference being had to the accompanying drawings, in which.

DETAILED DESCRIPTION OF THE INVENTION

Figure 1:
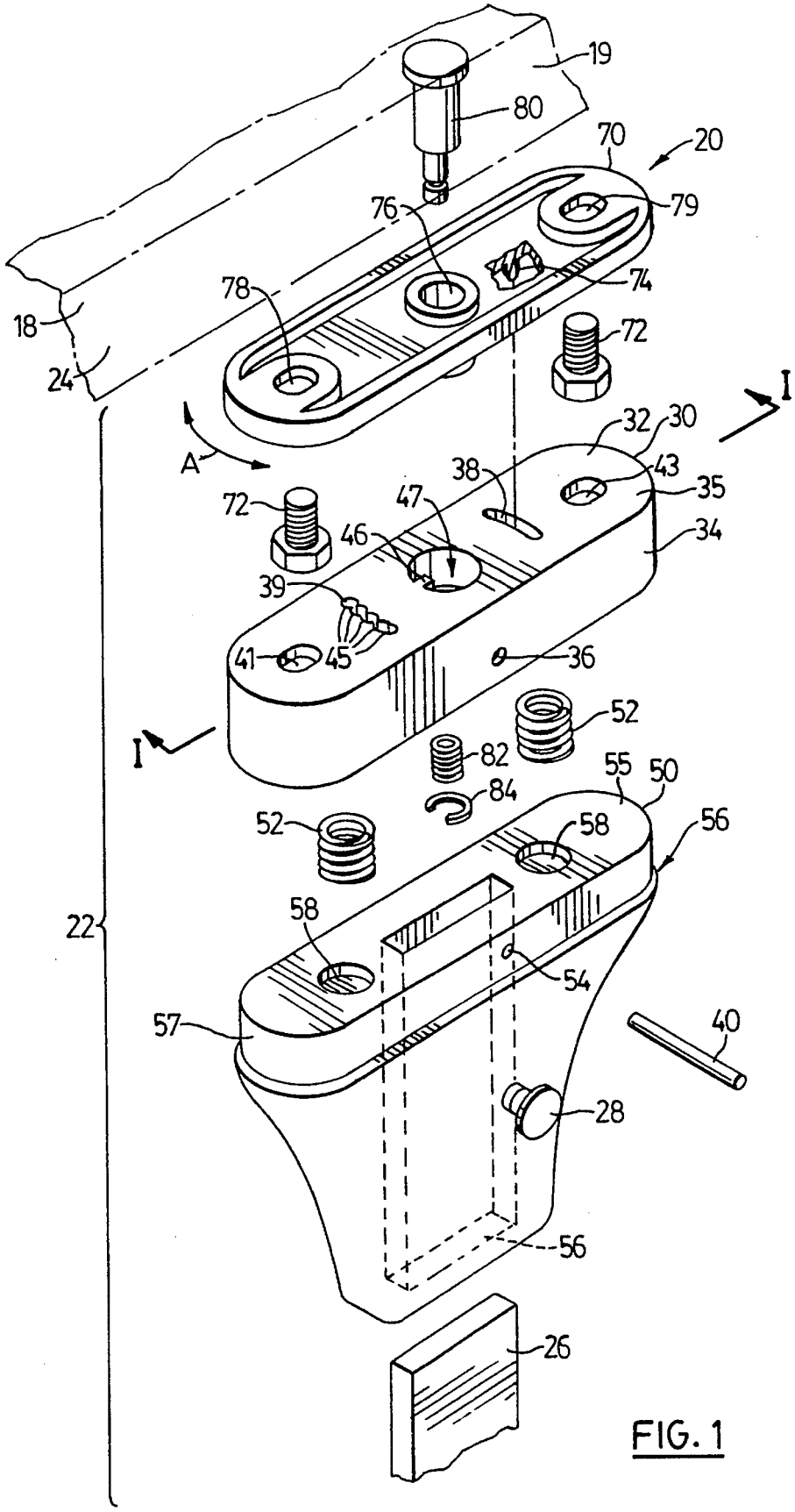
FIG. 1 is an exploded view of a chair armrest housing an armrest adjustment mechanism of this invention.

Referring first to FIG. 1, there is shown a chair armrest 20 including a chair armrest adjustment mechanism 22, armrest pad 24 having a front 19 and a back 18, armrest support member 26 and armrest height adjustment knob 28.

Chair armrest adjustment mechanism top 22 includes a first (medial) member 30, a second (base) member 50 and a third member 70. First member 30 has an oval shaped top wall 35 and side walls 34. Opposing side walls 34 contain aligned apertures 36 for reception of a pin 40. Top wall 35 of first member 30 has two arcuate slots 38 and 39. Slot 39 comprises an array of adjoining holes 45. The top wall 35 also has apertures 41 and 43 sized for reception of bolts 72 (although these apertures are not used in the embodiment shown in this figure). Top wall 35 also has spring cups 42 (FIG. 2) and a central stepped opening 47 containing tongue 46.

Second member 50 includes an oval top wall 55, base 57 and ledge 56. An aperture 54 within second member 50 receives pin 40. Top wall 55 of second member 50 contains spring cups 58.

First (medial) member 30 is pivotally mounted via pivot pin 40 to second (base) member 50. Springs 52 are received in spring cups 42 and 58 between first member 30 and second member 50 on either side of pivot pin 40 to bias the first member to a level position with respect to the second member.

To mount the second member to the armrest support member 26 of a chair slot 56 of second member 50 receives the armrest support member 26 and knob 28 threads through the side of the second member 50 to lock the second member to the support member 26.

Figure 2:
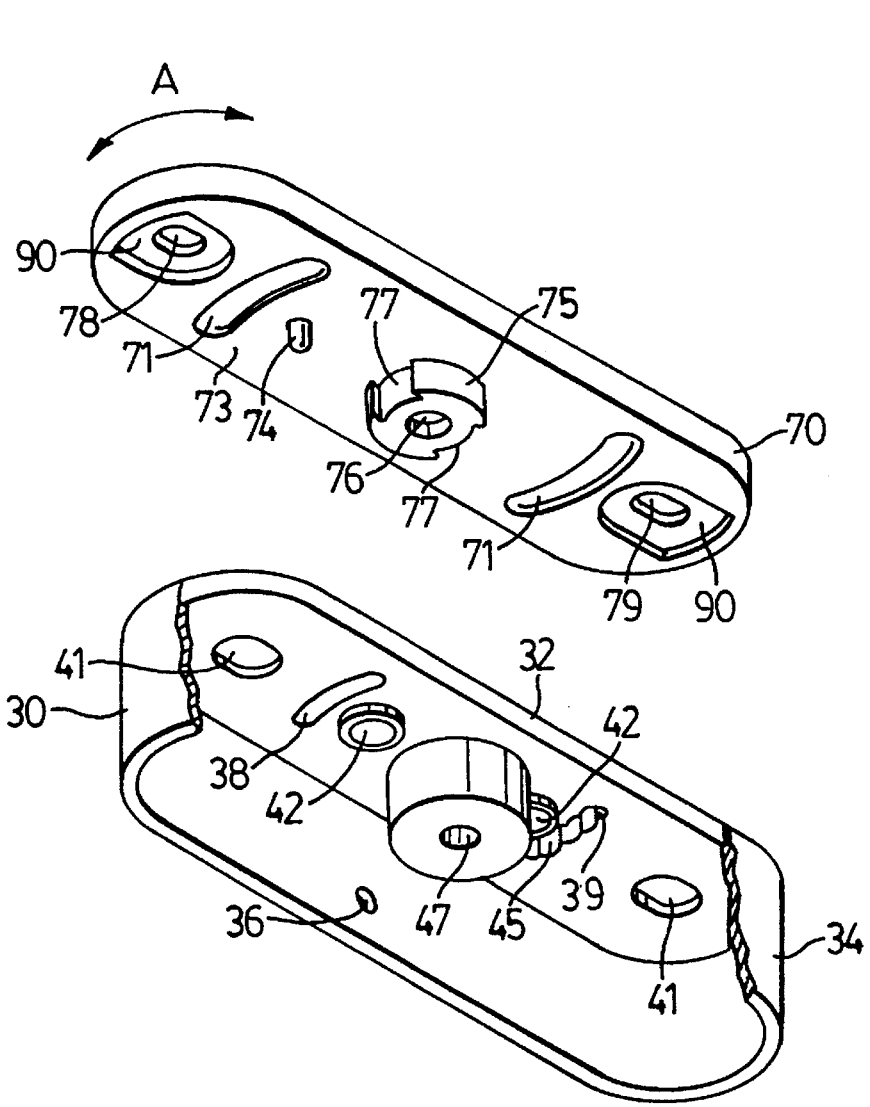
FIG. 2 is an exploded view of the bottom sides of a portion of the chair armrest adjustment mechanism of FIG. 1.

As shown in FIG. 2, third member 70 includes face 73 having arcuate pads 71 as well as apertures 78 and 79 for receiving bolts 72. Third member 70 also has a boss 75 with an aperture 76 therethrough and grooves 77. Shouldered shaft 80, inserted through aperture 76 in boss 75 of third member 70 and aperture 47 of first member 30, receives a spring 82 and retainer clip 84.

In the assembly of the armrest, third member 70 is fastened to armrest pad 24 via bolts 72. Boss 75 of third member 70 is inserted into opening 47 of first member 30 so that tongue 46 is aligned with a groove 77. Pin 74 is, as a result, received into either slot 38 or 39. Shaft 80 is inserted through openings 76 and 47 until the head 81 of the shaft abuts the third member. Spring 82 is then positioned on the shaft and clip 84 received by a notch in the shaft 80 to compress the spring between the first member and clip.

If pin 74 is received into slot 38, then the pin slides freely within the slot allowing third member 70 to rotate about its vertical axis in the direction as indicated by arrow A. Pin 74 may also be inserted into slot 39 if third member 70 is raised and rotated horizontally 180 degrees relative to first member 30. This results in pin 74 being received in a hole 45 of slot 39. The holes 45 adjoin but are sized to receive pin 74 so that it is not free to rotate to an adjoining hole. Pin 74 may be repositioned within slot 39 by lifting third member 70 in an upward direction thereby disengaging pin 74 from a hole within slot 39. Third member 70 may then be rotated horizontally to a new position and upon release of third member 70, spring 82 returns pin 74 into a new hole 45 of slot 39. Retainer clip 84 prevents shaft 80 from being removed from opening 47 of the first member 30 when third member 70 is lifted upwards.

Slots 38 and 39 have been designed to restrict the horizontal rotational movement of the armrest to sixteen degrees. Tongue 46 of opening 47 provides an additional rotational stop as the rotation of third member 70 is limited by the abutment of tongue 46 against the walls of groove 77.

Cavities 90 (FIG. 2), within third member 70, house the heads of bolts 72. Arcuate pads 71 (FIG. 2) provide a limited and smooth contact surface between third member 70 and first member 30 to reduce frictional resistance during rotation of third member 70.

Figure 3:
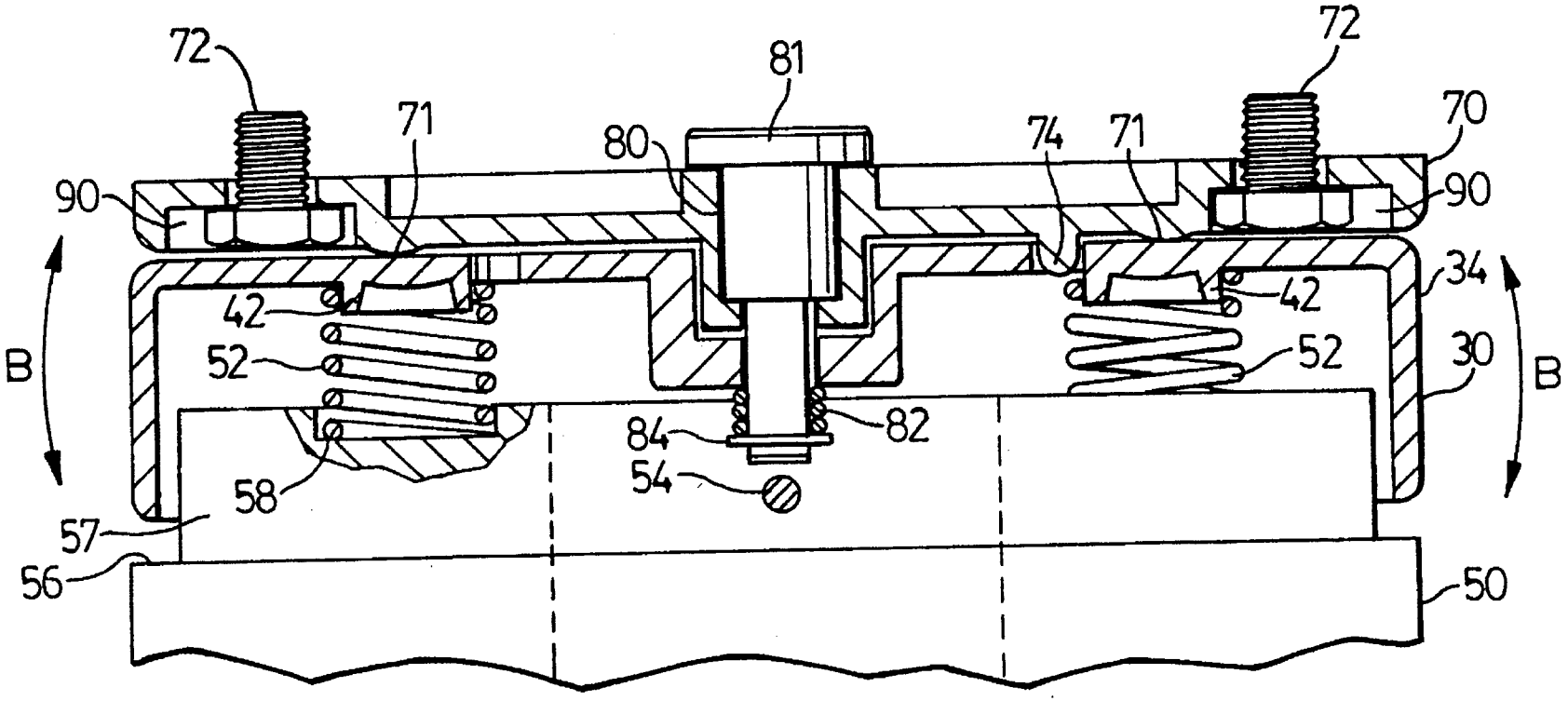
FIG. 3 is a cross sectional view of the armrest adjustment mechanism of FIG. 1 along the lines I—I.

As shown in FIG. 3, first member 30 encases the top wall of second member 50. Downward pressure on armrest pad 24 can cause first member 30 to pivot about pivot pin 40 allowing the armrest pad to tilt forward or backward in the direction as indicated by arrow B. Springs 52 cause the armrest pad to return to a rest position upon removal of the downward pressure. Ledge 56 of second member 50 restricts the degree to which the armrest pad may be tilted as base 34 of first member 30 will eventually abut against ledge 56. First member 30 may be pivotally mounted on second member 50 so as to restrict the degree to which the armrest pad may tilt to eight degrees from the horizontal.

In an alternate embodiment, third member 70 is not employed. Bolts 72 then extend through apertures 41 in first member 30 in order to fasten the first member 30 to armrest pad 24. The resulting armrest is limited to providing back and forth tilting of the armrest pad.

It will be appreciated by those skilled in the art that the chair armrest adjustment mechanism forming the subject invention may be integrated into a chair at the time of manufacture of the chair or alternatively, it may be manufactured as a separate unit and retrofitted into a chair.

While the armrest height adjustment mechanism forming the present invention has been described and illustrated with specific reference to the various embodiments, it will be appreciated that numerous variations of these embodiments may be made without departing from the scope of the invention described herein.

We claim:

1. A chair armrest adjustment mechanism comprising:

a top member having attachment means for mounting said member to an armrest pad, support means for mounting to an armrest support, mounting means for mounting said top member to said support means for side-to-side rotational movement of said top member relative to said support means, limiting means for limiting side-to-side rotational movement of said top member on said support means comprising a pin and slot arrangement, said pin extending from one of said top member and said support means and said slot extending in another of said top member and said support means, said slot comprising an arcuate array of holes, each of said holes sized such that on insertion of said pin into any one of said holes, said top member is fixedly positioned with respect to side-to-side rotational movement on said support means.

2. The mechanism of claim 1 wherein said limiting means further comprises a further slot in said another of said top member and said support means, said further slot sized to provide free movement of said pin therein.

3. The mechanism of claim 2 wherein said mounting means comprise a boss extending from a first one of said top member and said support means and an opening in a second one of said top member and said support means for receiving said boss.

4. The mechanism of claim 3 wherein said slot of holes and said further slot are opposed to one another on either side of said boss.

5. The mechanism of claim 4 including means to bias said top member toward said support means such that said pin is biased toward a position within one of said slot of holes and said further slot.

6. The mechanism of claim 5 wherein said biasing means comprise a shaft extending from said boss through said second one of said top member and said support means, a clip supported on said shaft on a side of said second one which is opposite said first one, and a spring compressed between said clip and said second one.

7. The mechanism of claim 6 wherein said support means comprises an upstanding base member and a medial member, said upstanding base member for mounting to an armrest support, said top member being mounted to said medial member, said medial member being pivotally mounted by a pivot to said upstanding base member such that a front end of said top member may tilt upwardly and downwardly relative to said base member.

8. The mechanism of claim 7 including biasing means between said base member and said medial member for biasing said medial member to a level position, said biasing means comprises a spring positioned on either side of said pivot.

9. The mechanism of claim 8 wherein said top member and said medial member comprise a tongue and groove arrangement therebetween to limit rotational movement of said top member relative to said medial member.

10. The mechanism of claim 1 including a raised pad on a face of one of said top member and said support means, said face facing another of said top member and said support means, said pad for reducing the frictional resistance between said top member and said support means during side-to-side rotational movement of said top member.

11. A chair armrest adjustment mechanism comprising:

a top member having attachment means for mounting said member to an armrest pad;

support means for mounting to an armrest support;

mounting means for mounting said top member to said support means for side-to-side rotational movement of said top member relative to said support means; and one of said top member and said support means comprising a raised pad facing the other of said top member and said support means, for reducing the frictional resistance between said top member and said support means during rotational movement.

12. The mechanism of claim 11 including limiting means for limiting side-to-side rotational movement of said top member on said support means comprising a pin and slot arrangement, said pin extending from one of said top member and said support means and said slot extending in another of said top member and said support means, said slot comprising an arcuate array of holes, each of said holes sized such that on insertion of said pin into any one of said holes, said top member is fixedly positioned with respect to side-to-side rotational movement on said support means.

13. The mechanism of claim 12 wherein said limiting means further comprises a further slot in said another of said top member and said support means, said further slot sized to provide free movement of said pin therein.

14. The mechanism of claim 13 including means to bias said top member toward said support means such that said pin is biased toward a position within one of said slot of holes and said further slot.

15. The mechanism of claim 14 wherein said support means comprises an upstanding base member for mounting to an armrest support and a medial member to which said top member is mounted, said medial member pivotally mounted to said upstanding base member such that a front end of said top member may tilt upwardly and downwardly relative to said base member.

* * * * *